US006877744B2

(12) United States Patent
Such

(10) Patent No.: US 6,877,744 B2
(45) Date of Patent: Apr. 12, 2005

(54) GAME USING COMBINED COIN BOARD AND SEAL CARD CREATING AN ACTION BOARD

(76) Inventor: David Allan Such, 301 20th Ave. South, Great Falls, MT (US) 59405

( * ) Notice: Subject to any disclaimer, the term of this patent is extended or adjusted under 35 U.S.C. 154(b) by 0 days.

(21) Appl. No.: 10/269,013

(22) Filed: Oct. 10, 2002

(65) Prior Publication Data

US 2003/0067109 A1 Apr. 10, 2003

Related U.S. Application Data

(60) Provisional application No. 60/328,570, filed on Oct. 10, 2001.

(51) Int. Cl.[7] ..... A63F 3/06

(52) U.S. Cl. ..... 273/139; 283/903; 283/901

(58) Field of Search ..... 283/901, 903; 273/139, 269; 206/8, 81, 8 L, 83, 84; 40/27.5; 229/92.9

(56) References Cited

U.S. PATENT DOCUMENTS 2,860,774 A * 11/1958 Ball ..... 206/0.84
3,047,144 A * 7/1962 Wissel ..... 206/0.83
3,579,878 A * 5/1971 Griffin et al. ..... 40/654.01
4,429,787 A * 2/1984 Morse ..... 206/0.83
5,046,737 A * 9/1991 Fienberg ..... 273/139
5,657,991 A * 8/1997 Camarato ..... 273/269
5,743,524 A * 4/1998 Nannicola ..... 273/139
5,931,468 A * 8/1999 Orolin ..... 273/139
5,934,671 A * 8/1999 Harrison ..... 273/139

* cited by examiner

*Primary Examiner*—William M. Pierce
(74) *Attorney, Agent, or Firm*—Randy A. Gregory; Gregory I.P. Law

(57) ABSTRACT

Coin Boards and Seal Cards have been used in conjunction with the playing of Pull-Tab Gambling games in the market place for many years. However, we are not aware of the Coin Board or Seal Card games being combined and used in conjunction with the real-time play of a Pull-Tab game. The Action Board, is a combination Coin Board and Seal Card providing Player excitement, heretofore, not available. The real-time play and combination of Pull-Tab instant prizes, inter-acting and in conjunction with Coin Board and Seal Card instant prizes during the playing of the basic Pull-Tab game differentiate the invention from the typical Coin Board or Seal Card game. The typical Coin Board or Seal Card games are played separately from each other, after all the tickets that comprise the game are sold out, the Coin Board or Seal Card prize winners are identified and the prizes awarded.

13 Claims, 6 Drawing Sheets

PULL-TAB FRONT PULL-TAB OPEN SIDE

*(TICKETS MAY BE 1, 2, 3, 4, 5 OR ANY NUMBER OF PULL-TAB WINDOWS AND ANY SIZE)*

*(MAY BE ANY SIZE)*

SEAL CARD

TABS / SEALS

COIN BOARD

ACTION BOARD CONSTRUCTION

GAME USING COMBINED COIN BOARD AND SEAL CARD CREATING AN ACTION BOARD

CROSS-REFERENCE TO RELATED APPLICATION

Continuation of Provisional Patent Ser. No. 60/328,570 filed Oct. 10, 2001.

BACKGROUND OF THE INVENTION

1. Primary Field of the Invention

This invention is directed to and used in conjunction with a Pull-Tab game of chance kit used by charitable organizations, clubs, taverns, and the like whereby members or customers can purchase a ticket and instantly win a prize if the ticket is a "Winner." These kits are sold through licensed distributors in states where such games are legal. Typically, the kit is purchased by the charitable organization, club or tavern, the tickets are then sold, and the instant prizes are paid by the kit purchaser. The number of winners is precisely controlled so that the income from ticket sales will exceed the total cost of the instant prizes and so that the ticket purchaser will know in advance the payout if all tickets are purchased.

2. Secondary Field of the Invention

Games of Chance Kits used for Advertising Promotions to build Consumer traffic, Brand awareness, or Incentive Programs.

3. Description of Prior Art

Coin Boards and Seal Cards have been in the market place for many years, however, we are not aware of the two game methods being combined and used in conjunction with the real-time play of a Pull-Tab game. The Action Board provides Player excitement, heretofore, not available. The real-time play and combination of tabs, or seals and coins of the Action Board differentiate the invention from the typical Coin Boards or Seal Cards which are played after all the tickets that comprise the game are sold and the tabs, or seals and coins are not combined.

SUMMARY OF THE INVENTION

In the practice of the present invention, wherein there is provided a lottery game kit comprising a set of game tickets of a pre-selected number, which tickets can be purchased by game players. Each ticket has concealed indicia (symbols or numbers), some of which indicate entitlement to an instant prize and/or eligibility for play on the Action Board. Each ticket contains indicia of a particular game set. A game set comprises both winners and losers. The lottery game kit further comprises the Action Board indicating the correspondence between ticket indicia, instant prizes and Action Board prizes.

The Action Board announces and advertises additional prizes. The Action Board has two sections. In one section is located a series of tabs or seals that are numbered or otherwise identified. In another section is located a plurality of coins embedded in the Action Board that are also numbered or otherwise identified. Under each tab, seal or coin is an indication whether or not a prize is to be paid to the ticket holder holding a ticket bearing the number or other form of identification corresponding to the tab, seal or coin. The tab, seal or coin could also re-direct the ticket holder to another tab, seal or identified coin. These prizes may be in addition to an instant prize already paid to the ticket holder.

BRIEF DESCRIPTION OF THE DRAWINGS

Further features and other objects and advantages of this invention will be made clear from the following detailed description made with reference to the drawings in which.

DETAILED DESCRIPTION OF THE PREFERRED EMBODIMENTS

Figure 2:
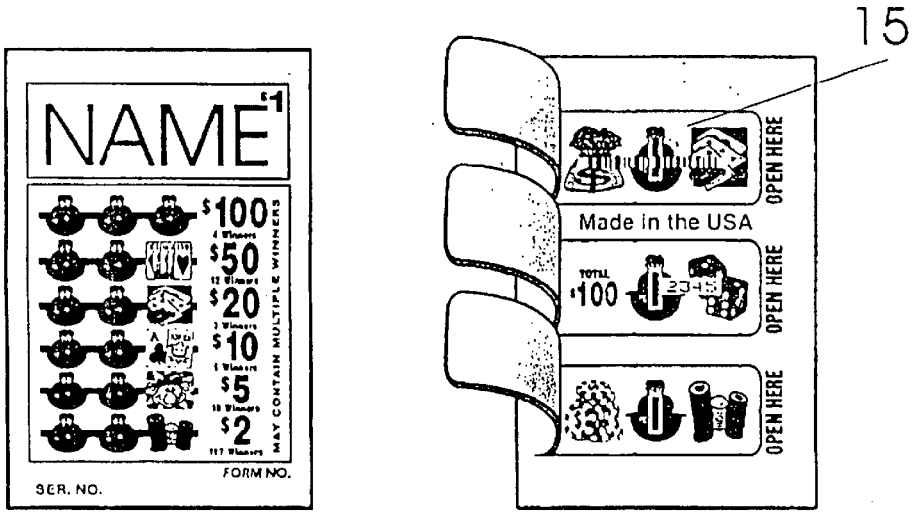
FIGURE 2 Prior Art
FIG. 2: example of other forms of tickets
Figure 2:
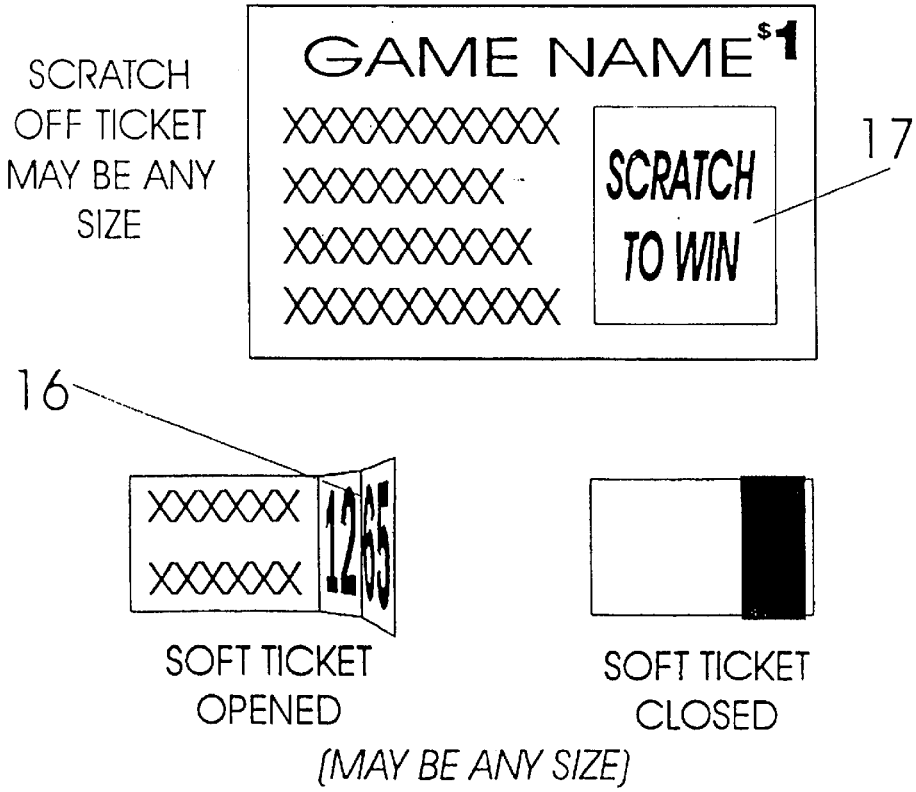
FIGURE 2 Prior Art

Pull-Tab Tickets (FIG. 2) include a laminated upper and lower layer of material such that until torn apart by removing a tab, the indicia (symbols or numbers) hidden therein are not visible 15. Alternately, the ticket may be folded and sealed such that until the seal is unbroken and the ticket is unfolded, the hidden indicia are not visible 16. Alternately, another popular ticket is known as a Scratch-Off ticket that until the covering material is scratched away, the hidden indicia are not visible 17. Thus, other types of tickets are suitable for use in game kit according to the present invention (FIG. 2).

Figure 3:
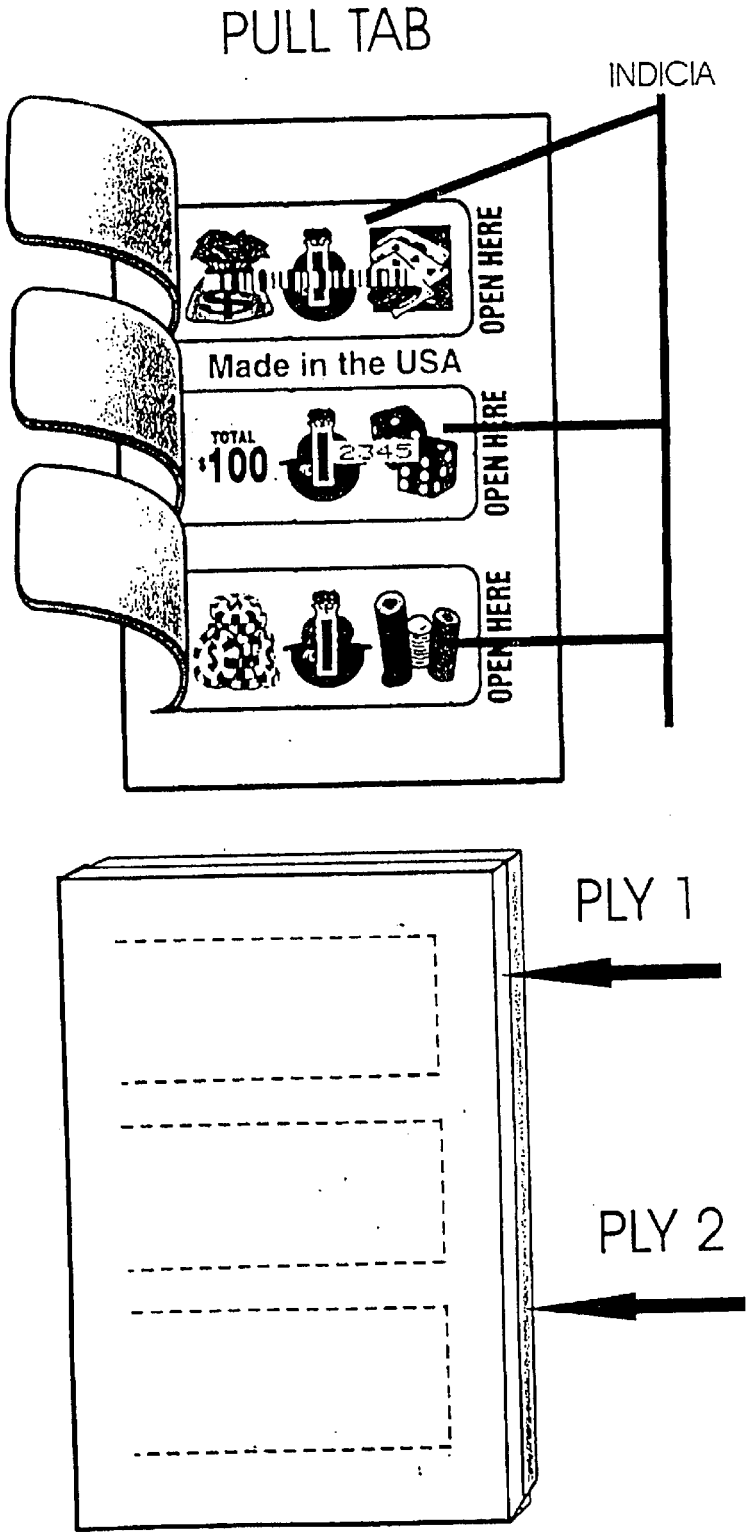
FIGURE 3 Prior Art
FIG. 3: is a Pull-Tab/Indicia
Figure 4:
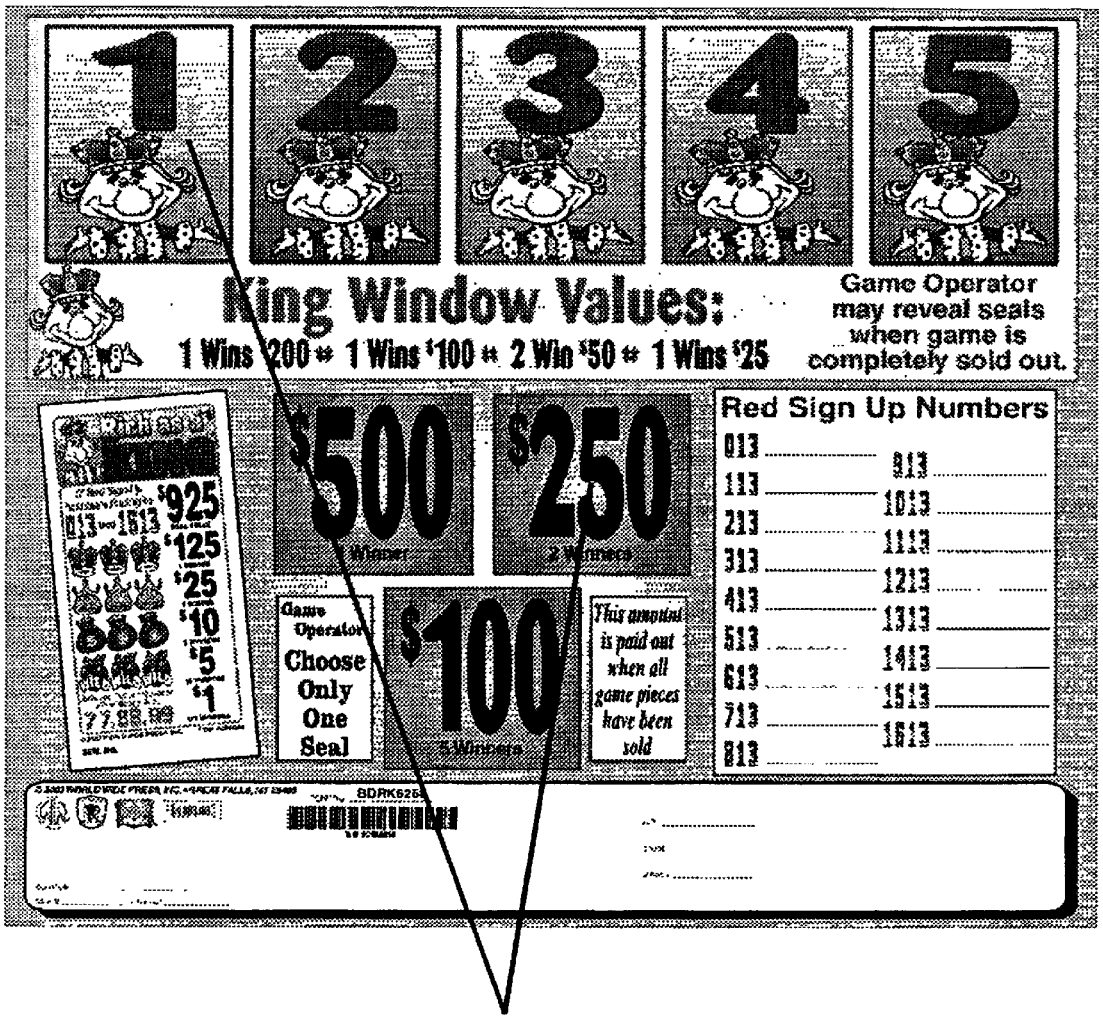
FIG. 4: is a Seal Card
Figure 5:
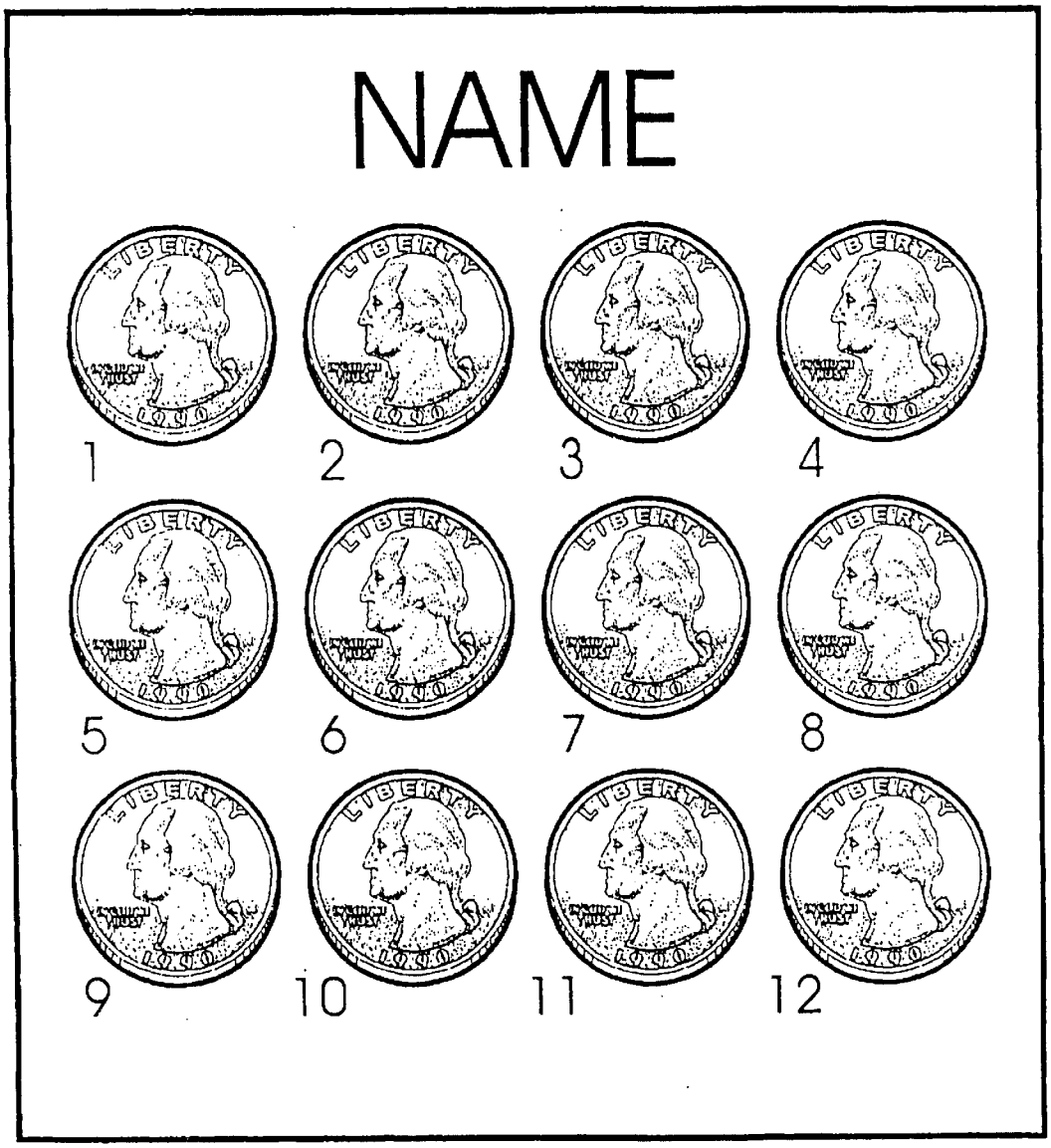
FIGURE 5 Prior Art
FIG. 5: is a Coin Board

The indicia (FIG. 3) of the game set on each eligible ticket enables an audit of the drawing to reduce the opportunity for fraudulent entries.

Figure 1:
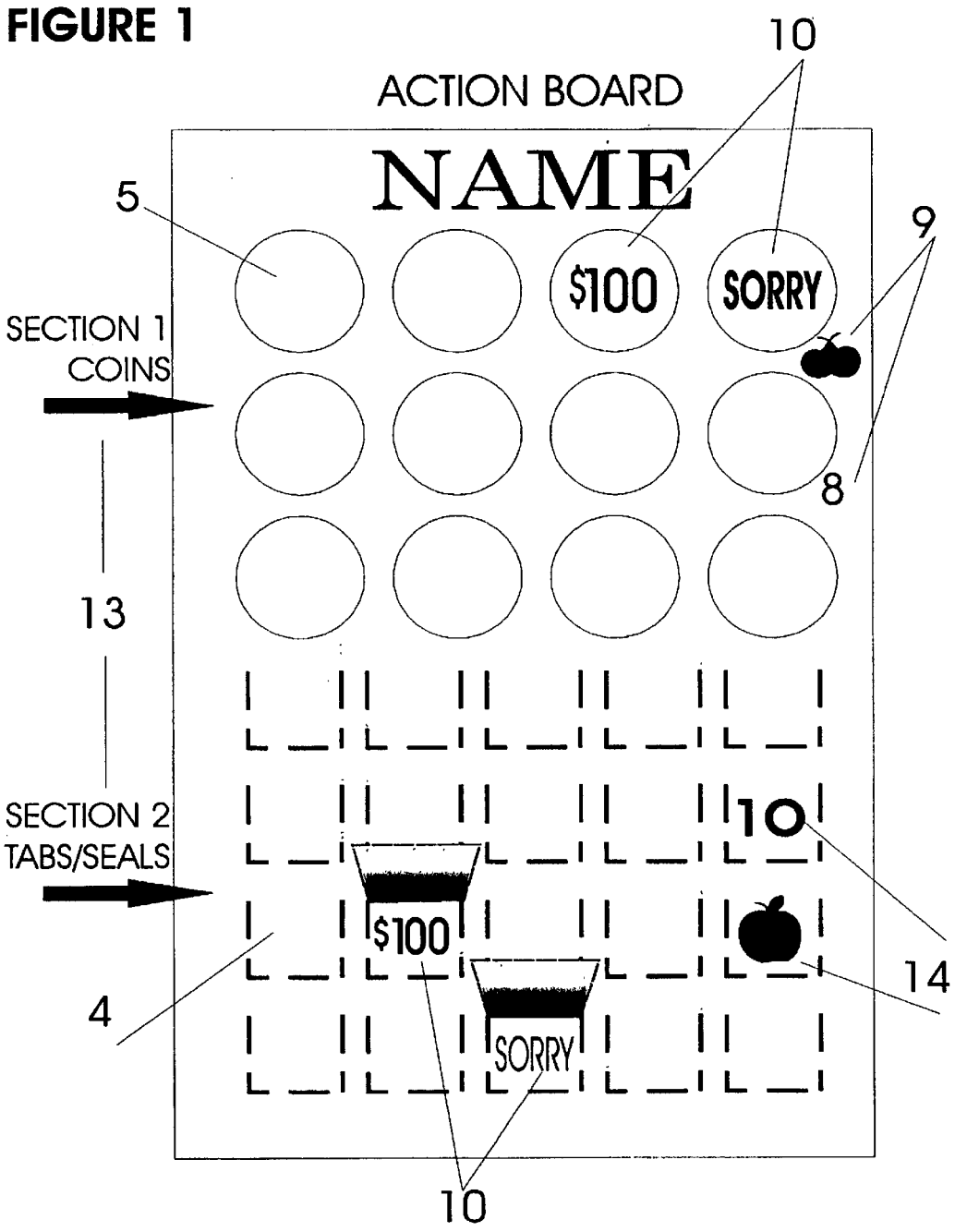
FIG. 1: is an Action Board

The Action Board (FIG. 1) announces and advertises additional prizes. The Action Board has two sections 13. In one section is located a series of tabs or seals 4 that are numbered or otherwise identified 14. In another section is located a plurality of coins 5 embedded in the Action Board that are also numbered or otherwise identified 9. Under each tab, seal or coin is an indication whether or not a prize is to be paid to the ticket holder holding a ticket bearing the number or otherwise identified indicia corresponding to the tab, seal or coin 10. The prize may be in addition to an instant prize already paid to the ticket holder.

Certain ticket holders will be directed to remove a tab or seal embedded in the Action Board 4. They are directed to remove the tab or seal associated with a number or otherwise identified indicia on the Action Board that corresponds to a number or otherwise identified indicia 9 on the holder's ticket. Under each tab or seal is an indication whether or not a prize 10, in addition to any instantaneous prize already paid, will further be paid.

Figure 6:
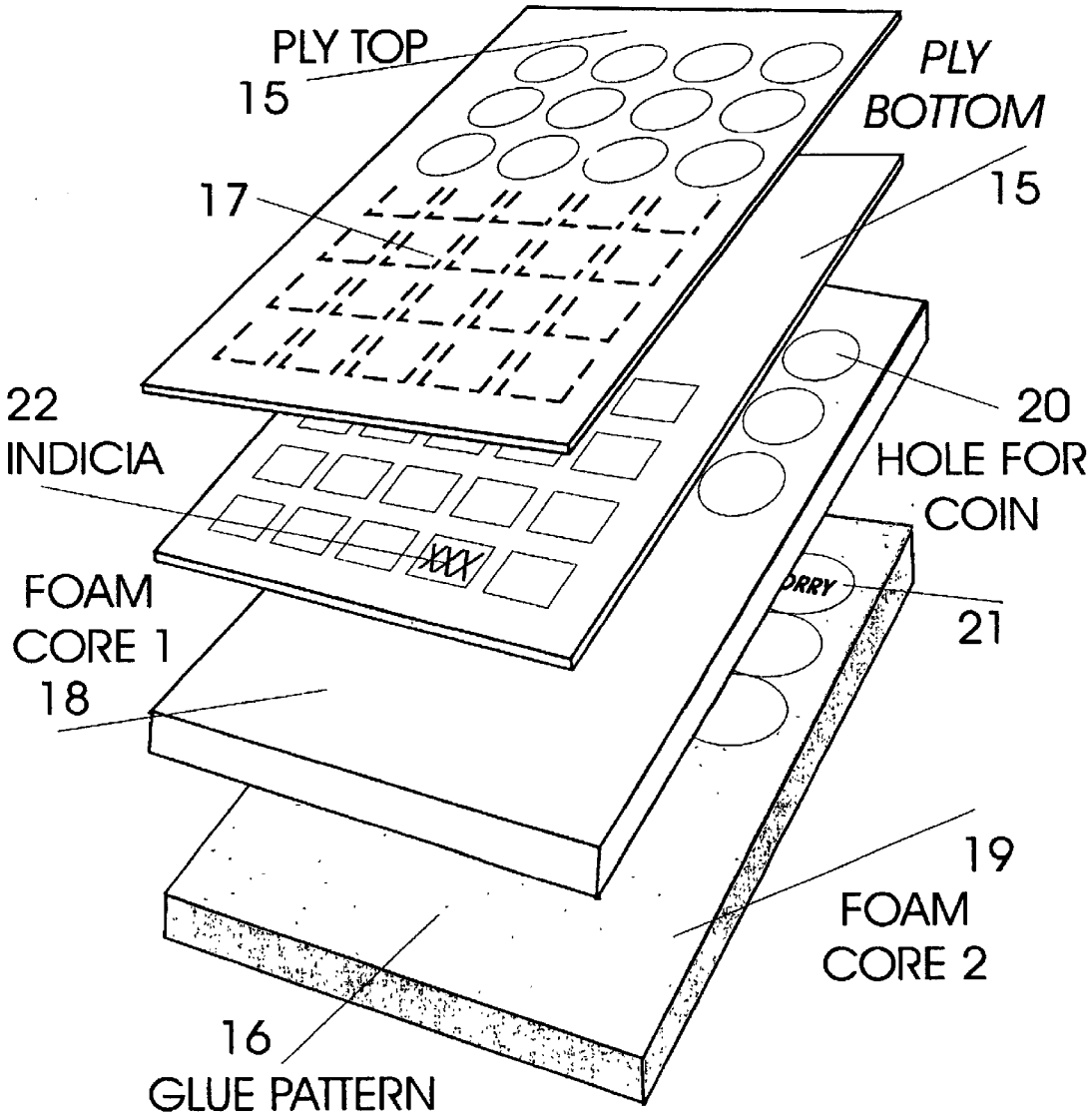
FIG. 6: construction of Action Board

The Action Board is constructed (FIG. 6) of at least two ply of paper or paperboard, of which each ply may be of the same thickness or varied thickness 15 laminated together with a unique adhesive pattern 16. The top ply, at least, is die cut with a perforated pattern creating the tabs or seals 17. The bottom most ply is never die cut and displays a number or otherwise identified indicia which is printed on the ply 22. The two or more ply of laminated paper or paperboard are then laminated to two laminated ply of foam core 18, 19 of which each ply may be of the same thickness or varied thickness. The top ply of foam core has the coin shape punched and removed from the foam core 20. The punched or top ply of foam core is then laminated to the bottom or base ply with an adhesive, thus creating a cavity for the coin to be placed 20. Prior to placing the coins into their respective cavities a number or otherwise identified indicia is placed on the bottom ply 21 to be covered by the coin. Upon completion of the coins being placed in their respective cavities the entire coin area is covered with clear Mylar, clear tape or similar appropriate covering so that the coins are visible and contained.

In another form, the invention includes an apparatus having a chance or lottery game ticket and an action board having a plurality of seals or tabs and plurality of embedded coins thereon. A ticket set, each ticket comprising one or more seals or tabs or coverings which when opened reveal hidden indicia some of which entitle the purchaser to instant winnings and/or eligibility for play on the action board. There being a first mode of play wherein the hidden indicia on the ticket directs the holder to open a specified tab or seal covering an indicia which may or may not award a prize to the holder. There being a second mode of play where the hidden indicia on the ticket directs the holder to remove a specified coin from the action board covering indicia which may or may not award a further prize to the holder. The first and second modes of play may be reversed and still be in accord with the invention.

Having thus described my invention with detail and particularity required by the Patent Laws, what is desired to be protected by Letters Patent is set forth in the following claim.

I claim:

1. An apparatus forming a game kit for playing a game of chance, comprising:

an action board including:

a first section having a plurality of action board tabs or seals which may be displaced or removed;

a second section having a plurality of action board coin cavities for receiving coins therein;

a plurality of coins in the coin cavities;

action board location identifiers on the action board for indicating identified locations of said coins, tabs or seals;

action board prize indicators hidden under the coins, tabs or seals, said action board prize indicators serving to indicate if any prize is associated with an identified location of coin, tab or seal;

a ticket set corresponding with said action board, and including:

a plurality of game tickets, each of said game tickets being for play by a ticket player and having at least one concealed ticket indicia which is played by a ticket player who reveals the at least one concealed ticket indicia to determine if the at least one concealed ticket indicia indicates the ticket is a winning game ticket or a losing game ticket, and if the ticket entities a holder of the ticket to be eligible to play the action board in which case the ticket is an eligible game ticket.

2. An apparatus according to claim 1 wherein the eligible game ticket entitles the holder to play the action board at a specific board location identifier.

3. An apparatus according to claim 1 wherein the action board location identifiers include numbers.

4. An apparatus according to claim 1 wherein the action board location identifiers include symbols.

5. An apparatus according to claim 1 wherein said game tickets in said ticket set are identified with at least one ticket set identifier.

6. An apparatus according to claim 1 wherein:

said game tickets in said ticket set are identified with at least one ticket set identifier;

said action board is provided with at least one action board identifier which corresponds the action board with said game tickets of said ticket set.

7. An apparatus according to claim 1 wherein said ticket set includes a pre-selected number of game tickets.

8. An apparatus according to claim 1 wherein said ticket set includes a pre-selected number of game tickets which are identified with at least one ticket set identifier.

9. An apparatus according to claim 1 wherein the action board presents information indicating winning ticket indicia and action board prizes.

10. An apparatus forming an action board used to play a game of chance comprising:

a first section having a plurality of action board tabs or seals which may be displaced or removed;

a second section having a plurality of action board coin receptacles for receiving coins therein;

a plurality of coins covering the coin cavities and acting as location coverings;

action board location identifiers on the action board for indicating identified locations of said coins, tabs or seals;

action board prize indicators hidden under the coins, tabs or seals, said action board prize indicators serving to indicate if any prize is associated with an identified coin, tab or seal.

11. An apparatus according to claim 10 wherein the action board location identifiers include numbers.

12. An apparatus according to claim 10 wherein the action board location identifiers include symbols.

13. An apparatus according to claim 10 wherein the action board further comprises advertising of prizes.

* * * * *